US005858197A

United States Patent [19]

Takahashi

[11] Patent Number: 5,858,197

[45] Date of Patent: Jan. 12, 1999

[54] PROCESS FOR MANUFACTURING SUBSTRATE FOR INK JET RECORDING HEAD USING ANODIC OXIDATION

[75] Inventor: Hiroto Takahashi, Yokohama, Japan

[73] Assignee: Canon Kabushiki Kaisha, Tokyo, Japan

[21] Appl. No.: 429,466

[22] Filed: Apr. 27, 1995

Related U.S. Application Data

[63] Continuation of Ser. No. 197,567, Feb. 17, 1994, abandoned, which is a continuation of Ser. No. 1,658, Jan. 17, 1993, abandoned, which is a division of Ser. No. 711,419, Jun. 5, 1991, Pat. No. 5,210,549, which is a continuation of Ser. No. 367,327, Jun. 16, 1989, abandoned.

[30] Foreign Application Priority Data

Jun. 17, 1988 [JP] Japan ..... 63-148173

[51] Int. Cl.[6] ..... C25D 11/02

[52] U.S. Cl. ..... 205/122

[58] Field of Search ..... 205/122, 124

[56] References Cited

U.S. PATENT DOCUMENTS

| | | | |
|---|---|---|---|
| 3,674,659 | 7/1972 | Livermore et al. | 205/82 |
| 3,784,951 | 1/1974 | Steidel | 358/262 |
| 3,862,017 | 1/1975 | Tsunemitsu et al. | 205/124 |
| 4,333,226 | 6/1982 | Abe et al. | 438/659 |
| 4,460,938 | 7/1984 | Clei | 361/779 |
| 4,490,728 | 12/1984 | Vaught et al. | 347/60 |
| 4,535,343 | 8/1985 | Wright et al. | 347/64 |
| 4,596,994 | 6/1986 | Matsuda et al. | 347/64 |
| 4,694,306 | 9/1987 | Ikeda et al. | 347/64 |
| 4,777,494 | 10/1988 | Shibata et al. | 347/64 |
| 4,847,630 | 7/1989 | Bhaskar et al. | 347/63 |
| 4,847,639 | 7/1989 | Sugata et al. | 347/62 |
| 4,860,033 | 8/1989 | Shiozaki et al. | 347/64 |

FOREIGN PATENT DOCUMENTS

| | | |
|---|---|---|
| 0140611 | 5/1985 | European Pat. Off. . |
| 0286204 | 10/1988 | European Pat. Off. . |
| 3403643 | 8/1984 | Germany . |
| 62-201254 | 9/1987 | Japan . |

*Primary Examiner*—Kathryn L. Gorgos
*Assistant Examiner*—William T. Leader
*Attorney, Agent, or Firm*—Fitzpatrick, Cella, Harper & Scinto

[57] ABSTRACT

An ink jet recording head comprises a discharging opening for liquid discharge and an electricity-heat convertor. The electricity-heat convertor comprises a heat-generating resistor and electrodes attached to the resistor. The heat-generating resistor and electrodes are formed from a single layer of electroconductive material which is anodically oxidized to change it into an insulating material except in the region where the resistor and electrodes are located. The resistor is formed by anodically oxidizing a portion of the layer which remained electroconductive after the first anodic oxidation to obtain a desired resistance value.

11 Claims, 10 Drawing Sheets

FILM FORMATION

RESIST COATING

EXPOSURE

DEVELOPMENT

ANODIC OXIDATION

RESIST REMOVAL

PHOTOSENSITIVE RESIN COMPOSITION LAMINATION

EXPOSURE

DEVELOPMENT

TOP PLATE ADHESION

ANODIC OXIDATION FOR ADJUSTING RESISTANCE OF HEAT GENERATING RESISTOR

PROCESS FOR MANUFACTURING SUBSTRATE FOR INK JET RECORDING HEAD USING ANODIC OXIDATION

This application is a continuation of application Ser. No. 08/197,567 filed Feb. 17, 1994, now abandoned, which was a continuation of application Ser. No. 08/001,658 filed Jan. 7, 1993, now abandoned, which was a division of application Ser. No. 07/711,419 filed Jun 5, 1991 now U.S. Pat. No. 5,210,549, which is a continuation of application Ser. No. 07/367,327 filed Jun. 16, 1989, now abandoned.

BACKGROUND OF THE INVENTION

1. Field of the Invention

This invention relates to a substrate for an ink jet recording head, an ink jet recording head having such a substrate and methods for preparing them.

2. Related Background Art

An ink jet recording method is a recording method which performs recording by discharging an ink (liquid for recording) through discharging openings provided on a recording head and depositing this onto a recording medium such as paper, etc., and offers many advantages such that generation of noise is very small, and also high speed recording is possible and yet no specially formulated paper for recording is required, etc. and various types of recording heads have been developed.

Among them, the recording head of the type which permits heat energy to act on ink, thereby discharging the ink through discharging openings has advantages such as good response to recording signals and easy arrangement of multiple discharging openings at high density.

The recording head to be used for such a recording method has typically a construction as shown in the schematic perspective view of FIG. 1. Specifically, it is provided with a discharging opening 101 provided for forming flying droplets by discharging ink and a liquid channel 102 for supplying ink communications with the discharging opening. An electricity-heat converting element having a heat generating resistor which is a heat energy generator 104A is provided internally of the liquid channel 102, and electrodes for supplying current to the heat-generating resistor and a liquid chamber 103 for storing ink to be supplied into the liquid channel are provided on the upstream side of the liquid channel. In addition, a recording head can also be provided with, if necessary, a protective film having the property of enhancing ink resistance of the electricity heat converting element.

Such a head is generally prepared as shown in FIG. 2. FIG. 2 shows schematic sectional views of the preparation steps at the position when the recording head is cut at the II–II' portion shown in FIG. 1. First, the layer 251, a part of which becomes finally the heat-generating resistor (hereinafter called the heat-generating resistance layer), and the layer 252 a part of which becomes the electrodes (hereinafter called the electrode layer), are formed on a support 253 (steps (a), (b)). Then, the electrode layer 252 is subjected to patterning utilizing a photolithographic technique by use of photoresist 254 and an etching technique, and subsequently, the heat-generating resistance layer 251 is similarly subjected to patterning to form the heat-generating resistor and electrodes (steps (c) to (k)). Specifically, on the product (b) after completion of the step (b) is laminated a photoresist 254 such as photosensitive resin, etc. (step (c)), the photoresist 254 of the product (c) is subjected to pattern exposure (step (d)), followed by developing of the photoresist 254 of the product (d) (step (e)). By the step (e), the photoresist 254 has any unnecessary portions removed to produce a desired pattern shape. Next, the electrode layer 252 exposed on the product (e) is removed by etching (step (f)), and the remaining resist portion 254' of the product (f) thus prepared is removed (step (g)). Thus, a desired pattern of the electrode layer 252 is formed.

The pattern of the heat-generating resistance layer 251 is also formed according to the same steps as in the case of forming the pattern of the electrode layer 252. That is, the pattern of the heat generating resistance layer 251 is formed by lamination of the photoresist 254" (step (h)), pattern exposure on the photoresist of the product (h) by use of a photomask (step (i)), developing of the photoresist 254" subjected to pattern exposure of the product (i) for removal of unnecessary portions (step (j)) and etching of the exposed heat-generating resistance layer 251 of the product (j) (step (k)). Then, the resist 254'" is peeled off (step (l)). Next, after a protective film 255 having the property of ink resistance, etc. is formed (step (m)), a photosensitive resin 256 is laminated (step (n)), followed by exposure (step (o)) and development (step (p)), to form a wall 256' with the hardened film of the photosensitive resin subjected to patterning ((m) to (p)). This wall constitutes the liquid channel wall which can be filled with a liquid. Next, on the wall 256' is adhered (plastered) a ceiling 257, and thereafter a discharging opening is formed by cutting (not shown) to complete an ink jet recording head (step (q)).

Thus, the preparation method which has been used in the prior art comprises many steps, and in addition, it takes a long time for some of the steps, particularly the etching step. It has been recognized that too much preparation time is required. Also, there is room for improvement from the point that the positional precision of the individual members is worsened, because the number of patterning steps is high.

SUMMARY OF THE INVENTION

The present invention has been accomplished in order to solve the above problems, and its object is to provide a substrate for an ink jet recording head which can shorten the preparation time and is constructed with highly precise positioning of its respective members, and an ink jet recording head having such a substrate. Another object of the present invention is to provide methods for preparing them.

Still another object of the present invention is to provide an ink jet recording head comprising a discharging opening for liquid discharge and an electricity-heat convertor, said electricity-heat convertor having a region formed by oxidation of at least part of an electroconductive material, said region being adapted to generate heat.

Still another object of the present invention is to provide a process for preparing a substrate for a recording head having on a support an electricity-heat convertor utilized for liquid discharge, which comprises forming a layer of electroconductive material on said support and oxidizing at least part of the surface region of said layer to form the electrodes and heat-generating resistor portion of said electricity-heat convertor.

Still another object of the present invention is to provide a process for preparing a substrate for a recording head having on a support an electricity-heat convertor utilized for liquid discharge, which comprises forming a layer of electroconductive material on said support, oxidizing part of said layer to make it an oxide, and oxidizing at least part of the surface region of residual electroconductive portion to form the electrodes and heat-generating resistor portion of said electricity-heat convertor.

Still another object of the present invention is to provide an ink jet recording head comprising a discharging opening provided for forming flying droplets by liquid discharge and an electricity-heat convertor having a heat-generating resistor and a pair of electrodes electrically connected to said heat-generating resistor, said electrodes and said heat-generating resistor being formed of the same material.

Still another object of the present invention is to provide a process for preparing an ink jet recording head which comprises steps of (a) forming on a support a film having an electroconductive property and heat resistance and being capable of anodic oxidation;

(b) anodizing the region of said film other than regions becoming electrodes and a heat-generating resistor;

(c) laminating a photosensitive composition;

(d) removing partially said photosensitive composition to form at least a discharging opening and wall members and expose the region of said film becoming a heat-generating resistor;

(e) adhering a top plate; and (f) anodizing the exposed surface of said film to form a heat-generating resistor while leaving the unanodized region of said film as electrodes.

DESCRIPTION OF THE PREFERRED EMBODIMENTS

A preferred example of the present invention is described below with reference to the drawings.

Figure 1:
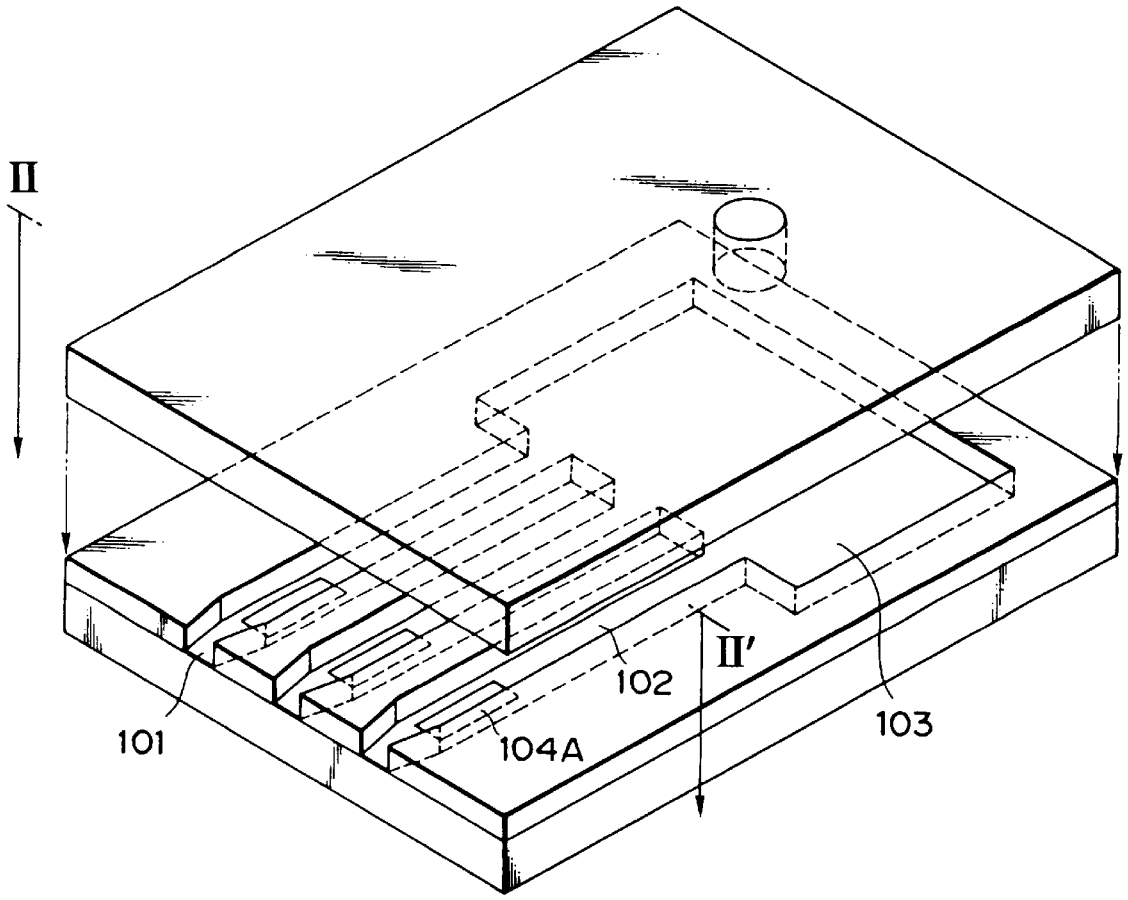
FIG. 1 is a schematic perspective view of a typical construction of a recording head for ink jet recording.
Figure 2A:
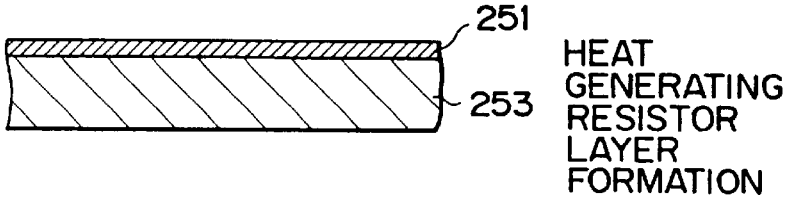
FIG.2(a) PRIOR ART
FIGS. 2(*a*)–2(*t*) show schematic sectional views of the preparation steps at the position when the recording head is cut at the II—II portion shown in FIG. 1.
Figure 2B:
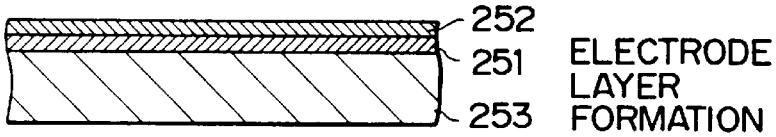
FIG.2(b) PRIOR ART
Figure 2C:
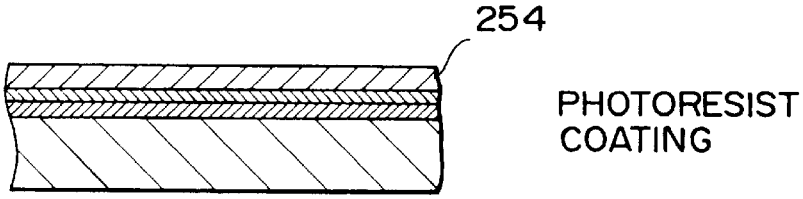
FIG.2(c) PRIOR ART
Figure 2D:
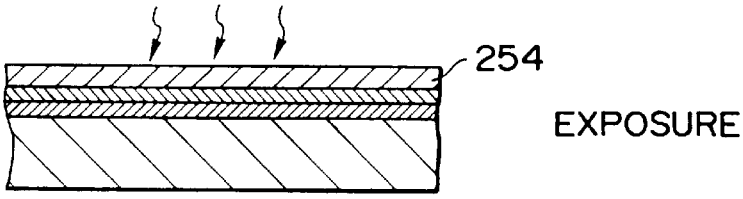
FIG.2(d) PRIOR ART
Figure 2E:
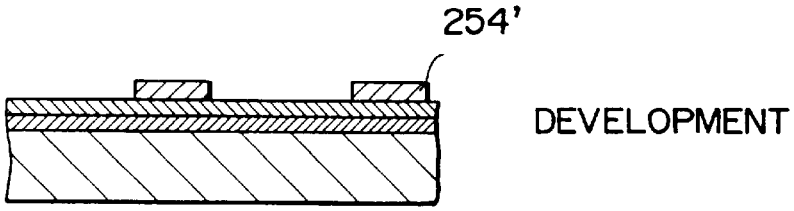
FIG.2(e) PRIOR ART
Figure 2F:
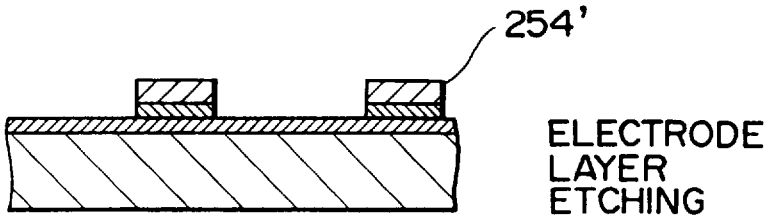
FIG.2(f) PRIOR ART
Figure 2G:
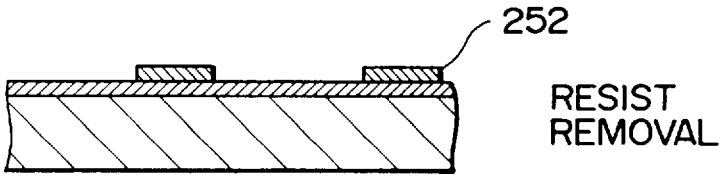
FIG.2(g) PRIOR ART
Figure 2H:
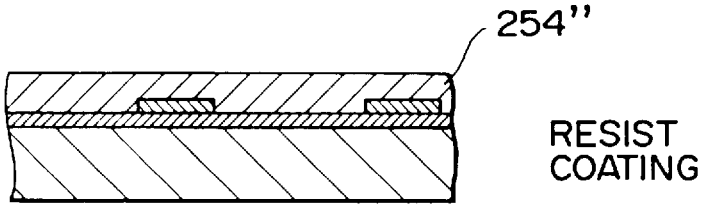
FIG.2(h) PRIOR ART
Figure 2I:
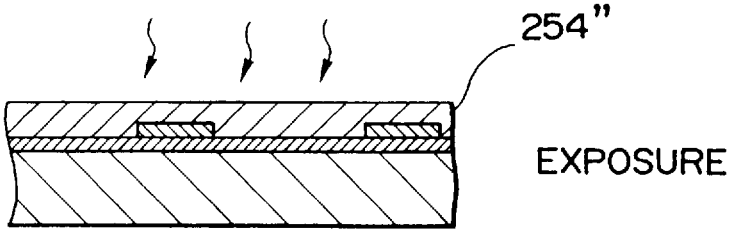
FIG.2(i) PRIOR ART
Figure 2J:
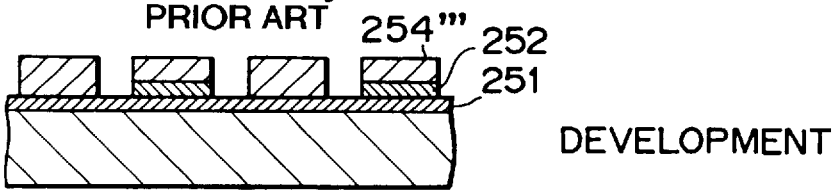
FIG.2(j) PRIOR ART
Figure 2K:
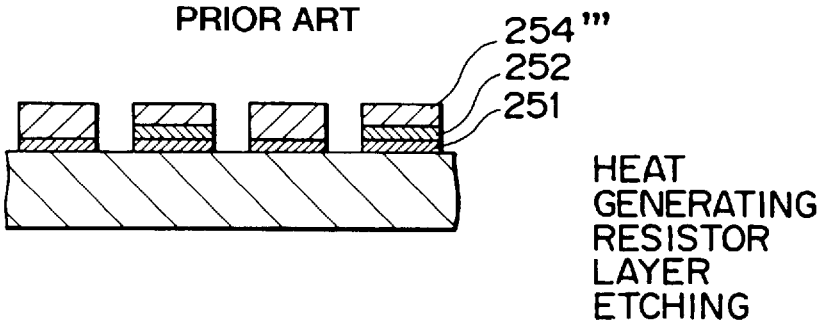
FIG.2(k) PRIOR ART
Figure 2L:
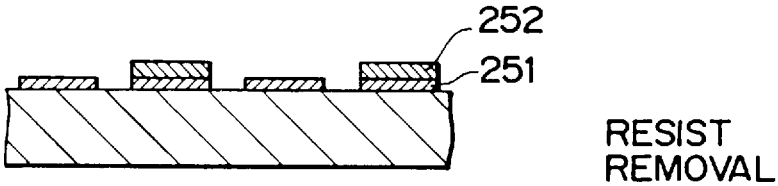
FIG.2(l) PRIOR ART
Figure 2M:
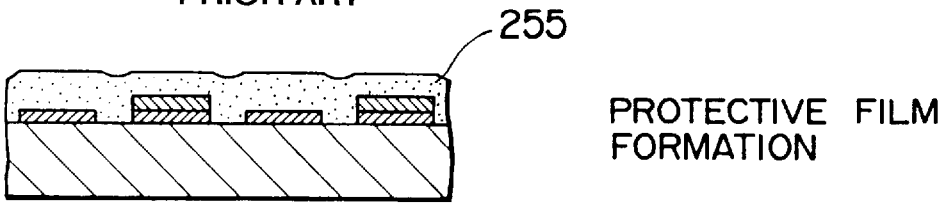
FIG.2(m) PRIOR ART
Figure 2N:
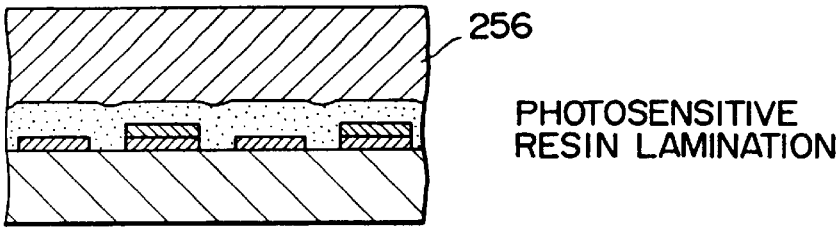
FIG.2(n) PRIOR ART
Figure 2O:
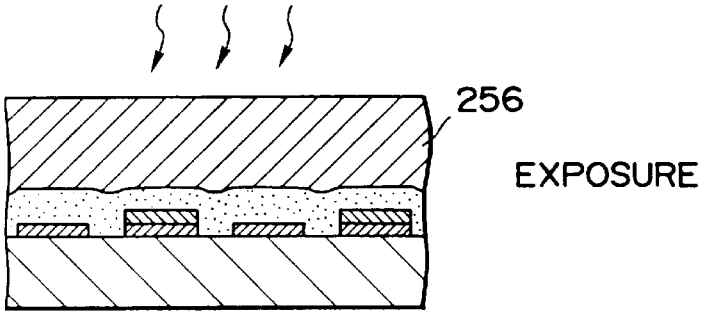
FIG.2(o) PRIOR ART
Figure 2P:
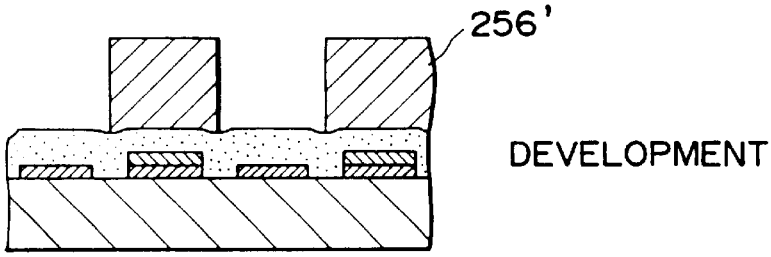
FIG.2(p) PRIOR ART
Figure 2Q:
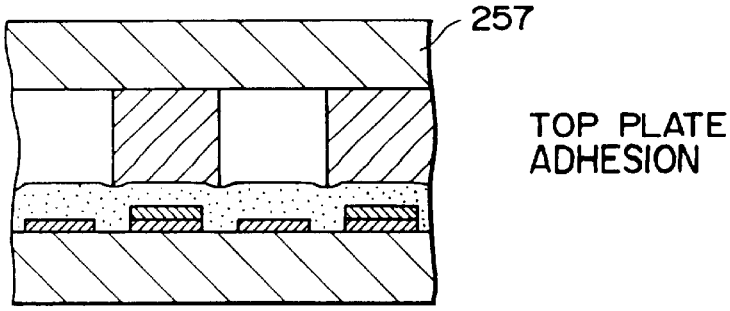
FIG.2(q) PRIOR ART
Figure 3A:
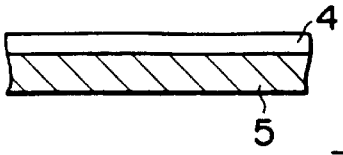
FIGS. 3(*a*)–3(*k*) shows schematic sectional views of the preparation steps of a recording head of the present invention.
Figure 3B:
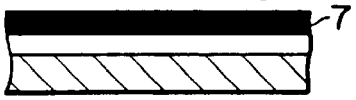
Figure 3C:
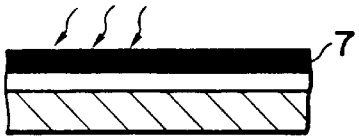
Figure 3D:
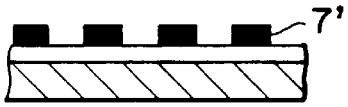
Figure 3E:
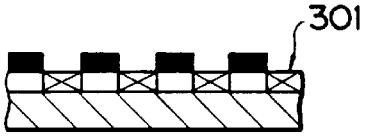
Figure 3F:
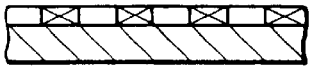
Figure 3G:
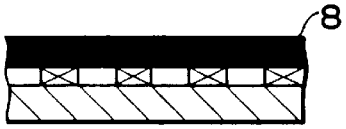
Figure 3H:
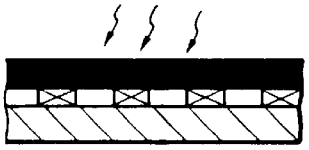
Figure 3I:
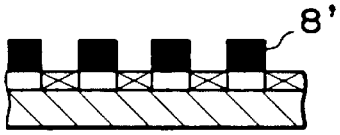
Figure 3J:
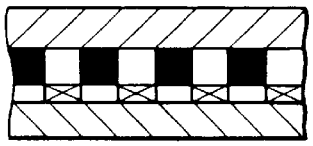
Figure 3K:
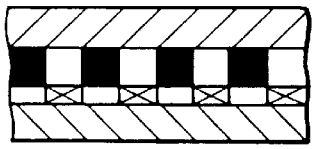
Figure 4A:
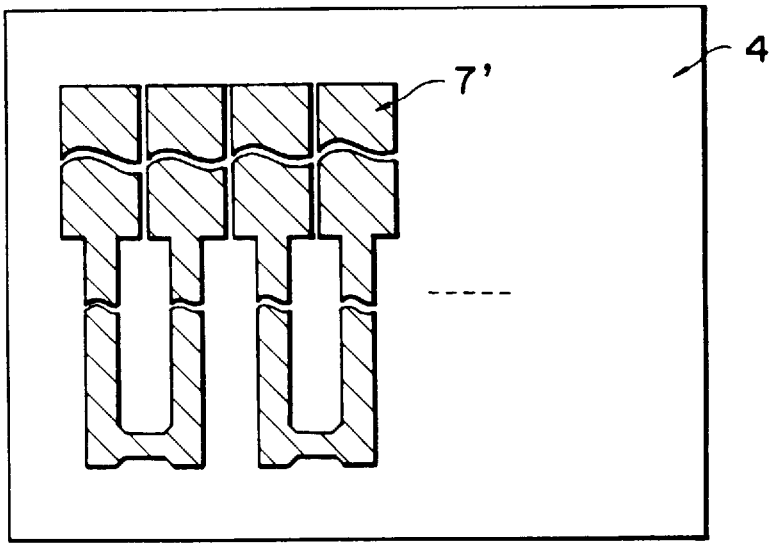
FIG. 4(*a*) to 4(*d*) are schematic plan views of the prepared products corresponding to FIG. 3(*d*), (*e*), (*f*) and (*i*), respectively.
Figure 4B:
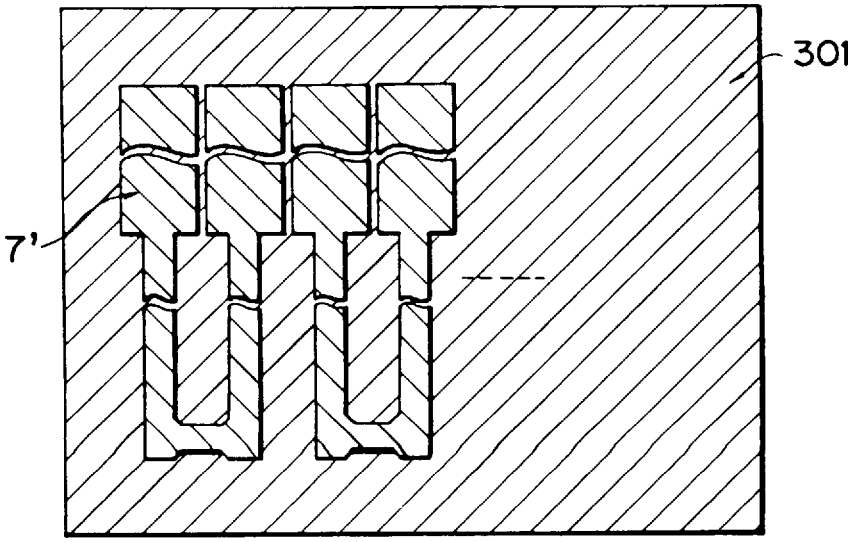
Figure 4C:
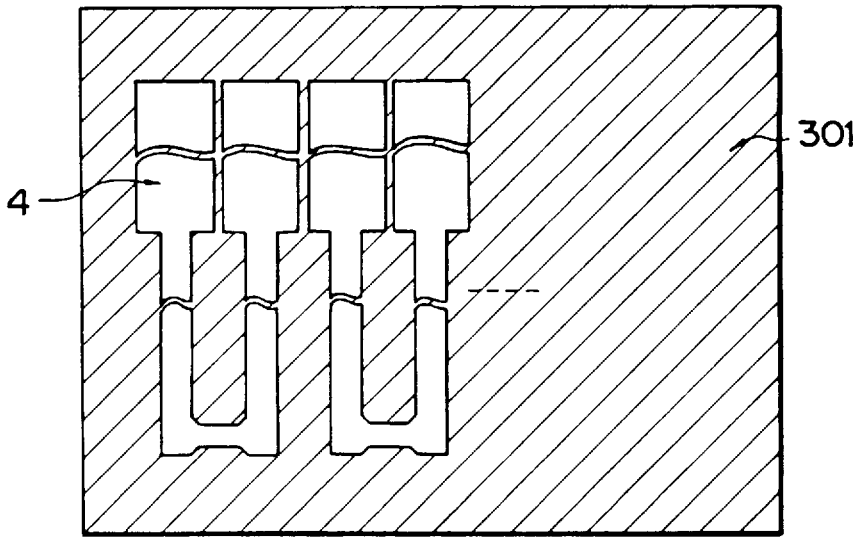
Figure 4D:
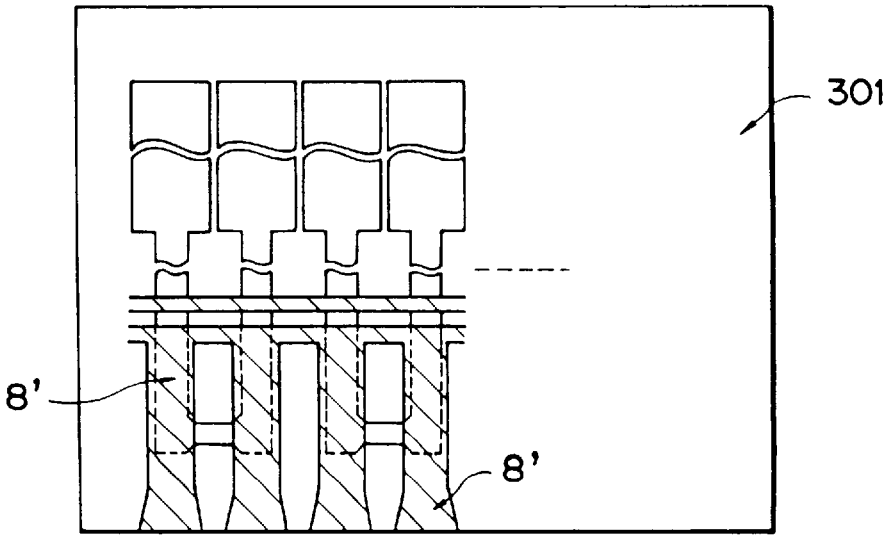

First, the present invention is briefly described by reference to FIG. 1 showing an embodiment of an ink jet recording head in an assembly diagram. That is, the ink jet recording head to which the present invention is suitably applied is an ink jet recording head having a discharging opening provided for forming flying droplets by discharging a liquid as represented by ink, a liquid channel for supplying the liquid to the discharging opening a liquid chamber for storing the liquid to be supplied to the liquid channel provided upstream thereof. A heat-generating resistor which is a heat energy source for forming flying droplets by discharging the liquid is provided corresponding to the liquid channel and at least a pair of electrodes electrically are connected to the heat-generating resistor on a substrate and form an electricity-heat converter with a pair of electrodes and the heat-generating resistor. The substrate includes a heat-generating resistor and electrodes and the heat-generating resistor and the electrodes are made from either a material or an oxidized form of that material. Also, the methods for preparing such substrate and recording head are proposed here.

Such an ink jet recording head can be prepared according to, for example, the steps of:

(a) forming a film which exhibits electroconductivity and heat resistance, and which can be anodically oxidized on a substrate;

(b) anodically oxidizing the above film except for the portions which become electrodes and heat-generating resistor to convert it into an insulating material;

(c) laminating a photosensitive composition wholly thereon;

(d) removing partially the photosensitive composition to form at least the discharging opening and the liquid channel side face simultaneously with exposing the above film at the portion which becomes the heat-generating resistor;

(e) adhering the ceiling plate; and (f) introducing an electrolyte into the liquid chamber and the channel formed in the step (e), oxidizing the exposed surface of the above film by anodic oxidation to form the heat-generating resistor. The details are described by referring to FIG. 3(*a*) to (*k*).

FIG. 4(*a*) to (*d*) show schematic plan views of the prepared products corresponding to FIG. 3(*d*), (*e*), (*f*) and (*i*), respectively. That is, FIG. 4(*a*) shows the state when the step shown in FIG. 3(*d*) is practiced, FIG. 4(*b*) that shown in FIG. 3(*e*), FIG. 4(*c*) that shown in FIG. 3(*f*) and FIG. 4(*d*) that shown in FIG. 3(*i*).

It should be noted that the schematic sectional view of the recording head shown in FIG. 1 as described above does not coincide with the shape of the recording head in the preparation procedure as described below.

First, on a support 5 such as glass, etc., a material which can become both the heat generating resistor and the electrodes is formed into a film (FIG. 3(*a*)). As the material, those which exhibit heat resistance and electroconductivity after film formation, and can be anodically oxidized can be utilized. For example, Ta, V, Nb, Zr, Mg, Zn, Ni, Gd, Co, etc. may be employed. The thickness of the film formed (film of the starting material) 4 should be preferably made about 500 to 20000 Å. The particular type of film forming method used may be selected according to the material and, for example, it may be preferable to use generally known vacuum deposition methods such as sputtering, vacuum vapor deposition, etc.

Subsequently, in the completed product, the film 4' except for the portions which become the heat-generating resistor and electrodes, is covered with a resist 7. For this purpose, the lithographic technique known in the art may be utilized (FIGS. 3(*b* to *d*))

Next, the film at the portion not covered with the resist 7 is converted to an insulating material by the anodic oxidation method shown in FIG. 3(*e*), and thereafter, the resist 7 is peeled off. As the treating solution to be used in this case, there may be included aqueous solutions of boric acid, tartaric acid, malonic acid, phosphoric acid, etc. These aqueous solutions may be preferably used particularly for anodic oxidation of a Ta film.

Figure 5:
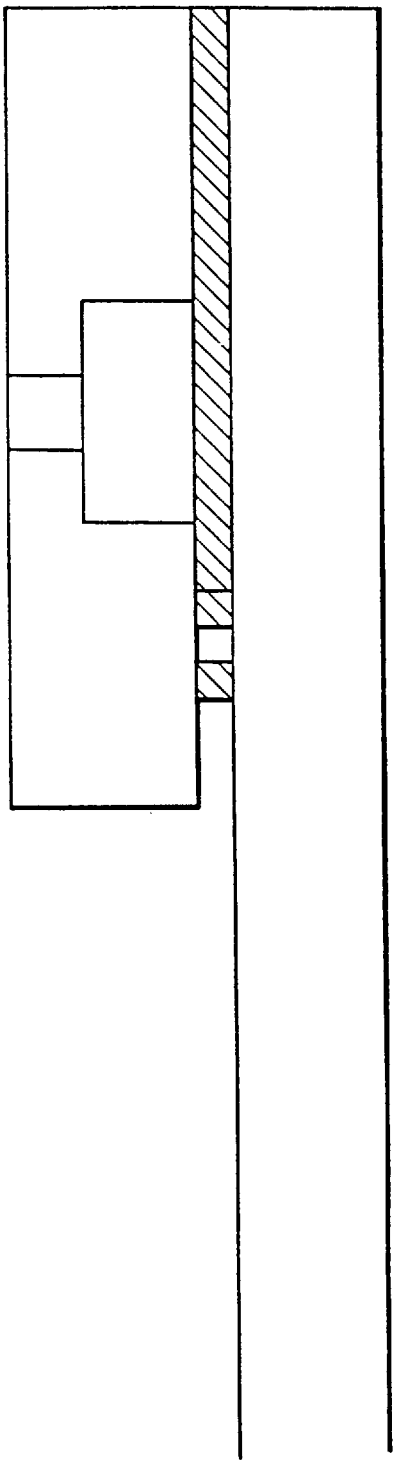
FIG. 5 is a sectional view of the completed product corresponding to V–V' in FIG. 7.

Subsequently, the photosensitive resin 8 of dry film, etc. is the photosensitive resin 8 such as a dry film is laminated over the whole surface of the film 4, as shown in FIG. 3(*g*) Thereafter, partial exposure and developing are practiced to effect patterning of the photosensitive resin 8 to form a pattern of the cured layer of the photosensitive resin ((h)–(i)). The cured layer defines the liquid channel and the discharging opening. For this step, a material which can be finely patterned after lamination can be utilized, including photosensitive resins. A schematic plan view of the product completed up to this step is shown in FIG. 4(*d*), and a sectional view (sectional view corresponding to V–V' in FIG. 7) of the completed product for reference in FIG. 5. The dashed straight line in each of FIG. 4(*a*) to 4(*d*) shows the portion converted to insulating material by anodic oxidation, and the other dashed portions in FIG. 4(*d*) show the region where the photosensitive composition is provided.

As shown in FIG. 4(*d*), care is taken so that the film at the portion which becomes the heat-generating resistor may not be covered with the photosensitive resin 8 at least after patterning, and the film at the portion which becomes electrodes may be covered with the photosensitive resin 8. It should be kept in mind that since succeeding processing steps may be performed upon the structure that has been formed, such as the anodic oxidation which takes place as shown in FIG. (k), processing up to this point should take place in a manner such that the succeeding processing of the film at the portion which becomes the electrodes takes place without incident. Such succeeding processing will now be described.

Next, on the cured layer 8' of the photosensitive resin defining the liquid channel and the discharging opening, etc., a ceiling of glass, etc. is plastered (adhered) to form the liquid channel, etc. Finally, an electrolyte solution (treating solution) containing an electrolyte is introduced into the liquid chamber and the liquid channel and again anodic oxidation is practiced ((k), the portion to be anodically oxidized is not shown). By doing so, the film surface at the portion which is not covered with the cured layer of the photosensitive resin is converted into an oxide to form a heat-generating resistor, and resistance at this portion is increased, thus completing the ink jet recording head as shown in FIG. 1.

In the case as described above, the first anodic oxidation should preferably convert the portion to be anodically oxidized completely to an insulating material, while the second anodic oxidation should be effected so that portion that is oxidized retains adequate electroconductivity to function as a resistor. Thus, the respective anodic oxidations are required to be practiced corresponding to these requirements.

The ink jet recording head completed as described above is formed of the heat-generating resistor and electrodes by use of the same material as the starting material, but the heat-generating resistor is essentially thinner than the portion other than that, namely electrodes, to be greater in resistance value.

The anodic oxidation of the film 4 which is the starting material in the above step will be described in more detail.

The case of forming tantalum (Ta) as the starting material film on the support will be specifically described below.

Based on the steps (a) to (d) in FIG. 3, the support was subjected to anodic oxidation treatment by use of 1% by weight of an aqueous phosphoric acid solution as the treating solution at a current density of 10 mA/cm$^2$ for a treatment time of 120 sec. By this treatment, the Ta film in contact with the treating solution was oxidized substantially completely in its thickness direction to be converted into an insulating material (FIG. 3, step (e)).

Next, after the ceiling plate of the recording head was bonded based on the steps (f) to (k) in FIG. 3, 1% by weight of an aqueous phosphoric acid solution was supplied into the recording head, and by oxidizing anodically the surface portion of the Ta film so that a desired resistance value may be obtained at a current density of 5 mA/cm$^2$ to form the portion which becomes the heat-generating resistor (FIG. 3, step (k)).

When recording was performed practically by supplying ink to the ink jet recording head thus prepared, recording could be done with extremely stable discharging characteristics.

In the foregoing examples, when the width of electrodes can be taken greater than that of the heater, the second anodic oxidation only of the heater region (by which heater resistance can be made sufficiently greater than electrode resistance) becomes unnecessary.

Figure 6:
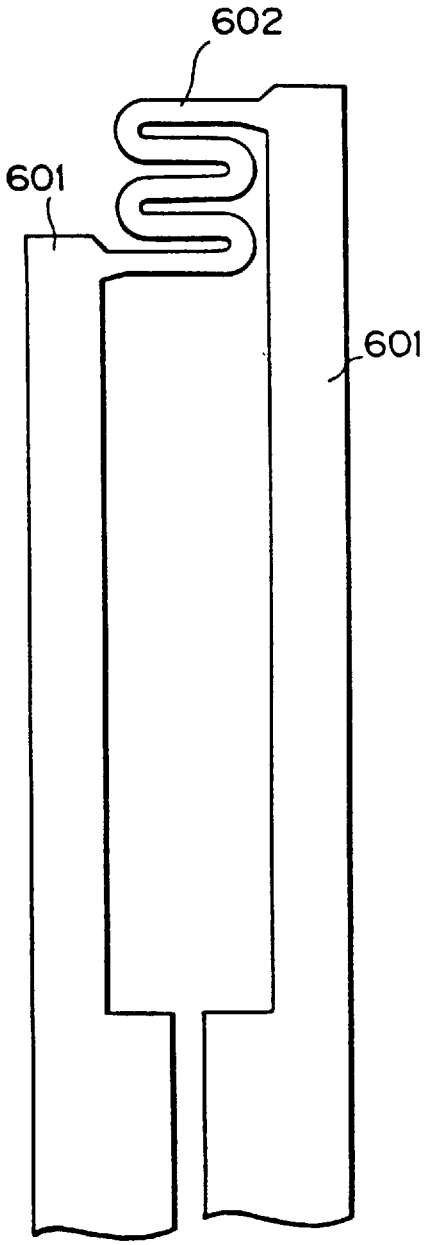
FIG. 6 is a schematic plan view showing the shape of an electrode region and a resistance heating region.

The shapes of the electrode region and the heat-generating resistor region may be any desired ones as shown in the schematic plan view in FIG. 6. In FIG. 6, 601 is the electrode region and 602 the heat-generating resistor region.

Figure 7:
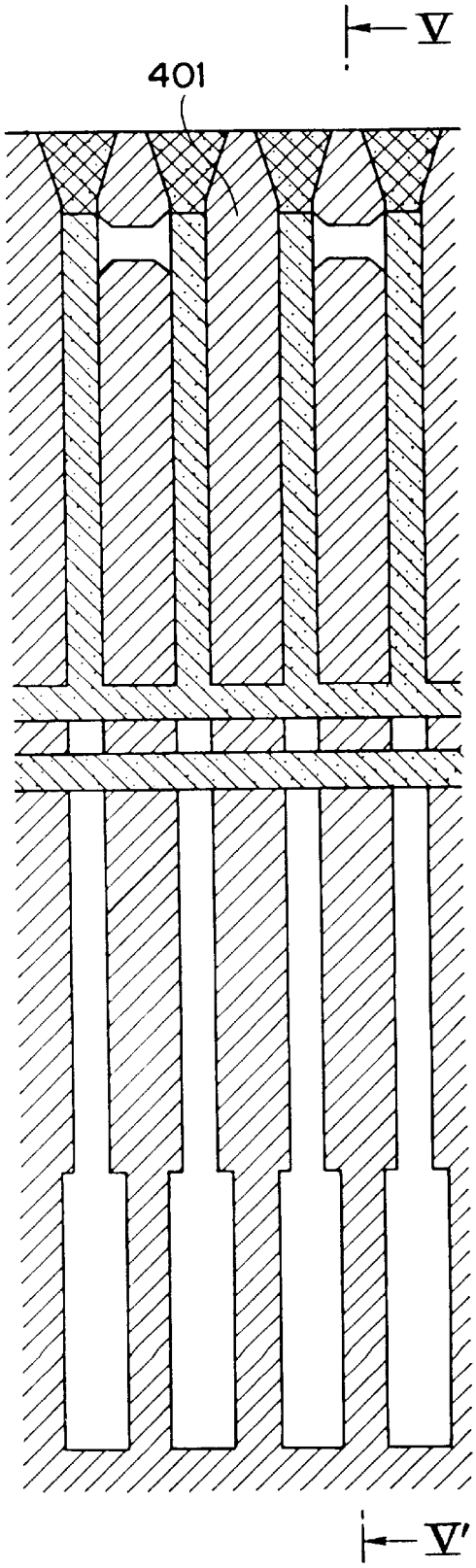
FIG. 7 is a schematic plan view, partially enlarged, of FIG. 4(*d*).

FIG. 7 is a schematic plan view, partially enlarged, of FIG. 4(*d*).

In the above description, the substrate having the electrode region and the heat-generating resistor portion region which has been formed there on by anodic oxidation, may itself be previously formed, and the liquid channel, etc. may be formed thereof to prepare a recording head.

The gaps between the respective heat-generating resistance elements are not necessarily required to be anodically oxidized, but unnecessary portions may be removed by etching, and the electrode region and the heat-generating portion forming the heat-generating resistance elements can be also anodically oxidized, if desired, to form heat-generating resistance elements.

As described in detail above, in the present invention, since the ink jet recording head can be prepared by two patterning steps and one film forming step, the number of steps can be shortened to a great extent. Also, according to the present invention, patterning is used only during anodic oxidation it does not require the use of an etching step, and in addition to the above reason, preparation time can be also shortened in this respect. Further, according to the present invention, the respective members can be provided with a high degree of positional accuracy In addition, according to the present invention, since the upper surface of the heat-generating resistance element (substrate upper surface) has little unevenness, peeling of the respective members, etc. will occur less frequently, whereby a recording head enriched in durability can be provided.

Also, it is within the scope of the present invention to change the order of the steps for the preparation of a recording head, as well as the constitution of the recording head.

What is claimed is:

1. A process for preparing a substrate for an ink jet recording head having on a support an electricity-heat converter for generating heat, said converter comprising a heat-generating resistor and electrodes attached to said resistor, said process comprising the steps of:

forming a layer of electroconductive material on the support;

defining in said layer of electroconductive material a first region and a remaining region, said remaining region including a relatively narrow portion between relatively wide portions; and anodically oxidizing said first region of the layer to change the electroconductive material in said first region into an insulating material, the anodically oxidizing being carried out such that said remaining region of the layer is not anodically oxidized, and wherein the heat-generating resistor is formed by the narrow portion and the electrodes are formed by the wide portions.

2. The process according to claim 1, wherein the anodic oxidizing of part of the layer is carried out utilizing a resist provided on the layer of electroconductive material.

3. The process according to claim 1, wherein a protective layer is further formed on at least part of the electricity-heat convertor.

4. A process for preparing a substrate for an ink jet recording head having on a support an electricity-heat convertor for generating heat, said converter comprising a heat-generating resistor and electrodes attached to said resistor, said process comprising the steps of:

forming a layer of electroconductive material on the support;

defining in said layer of electroconductive material a first region and a remaining region, said remaining region including a heat-generating resistor portion between electrode portions;

anodically oxidizing in a first anodic oxidation said first region of said layer to change the electroconductive material in said first region into an insulating material, the first anodic oxidation being carried out such that said remaining region of the layer is not anodically oxidized; and forming a heat-generating resistor having a desired resistance value by selectively anodically oxidizing in a second anodic oxidation said heat-generating resistor portion of said remaining region of said layer of electroconductive material, the second anodic oxidation being carried out such that the electrode portions between which the heat-generating resistor is formed are not anodically oxidized.

5. The process according to claim 1 or 4, wherein the electroconductive material is selected from the group consisting of Ta, V, Nb, Zr, Mg, Zn, Ni, Gd and Co.

6. The process according to claim 1 or 4, wherein the electroconductive material is formed by vacuum deposition.

7. The process according to claim 6, wherein the vacuum deposition is sputtering or vapor deposition.

8. The process according to claim 4, wherein said first region is defined by use of a photolithographic technique before the first anodic oxidation.

9. The process according to claim 4, wherein said heat-generating resistor portion is defined by use of a photolithographic technique before the second anodic oxidation.

10. The process according to claim 4, wherein a protective layer is further provided on at least part of the electricity-heat convertor.

11. A process for preparing an ink jet recording head comprising the steps of:

forming on a support an electrically conductive film capable of being anodically oxidized which, upon being anodically oxidized, becomes capable of producing heat in response to electrical current flowing therethrough;

defining in said electrically conductive film a first region and a remaining region, said remaining region including a heat-generating resistor portion between electrode portions;

anodically oxidizing in a first anodic oxidation said first region of said electrically conductive film to change said first region of said film into an insulating material, the first anodic oxidation being carried out such that said remaining region of the film is not anodically oxidized;

laminating a photosensitive composition on the film;

partially removing the photosensitive composition to form a plurality of wall members constituting a liquid path, said liquid path being positioned to expose said heat-generating resistor portion of said remaining region of said film;

bonding a top plate onto the wall members to form an enclosed liquid path; and anodically oxidizing in a second anodic oxidation said heat-generating resistor portion to form a heat-generating resistor, the second anodic oxidation being carried out such that the electrode portions between which the heat-generating resistor is formed are not anodically oxidized.

* * * * *

UNITED STATES PATENT AND TRADEMARK OFFICE

CERTIFICATE OF CORRECTION

PATENT NO. : 5,858,197

DATED : January 12, 1999

INVENTOR(S) : HIROTO TAKAHASHI

It is certified that error appears in the above-identified patent and that said Letters Patent is hereby corrected as shown below:

TITLE PAGE:

[63] RELATED U.S. APPLICATION DATA

"Jan. 17, 1993," should read --Jan. 7, 1993,--.

COLUMN 1

Line 39, "communications" should read --communicating--.

COLUMN 3

Line 31, "2(t)" should read --2(q)--.
Line 33, "II-II" should read --II-II[1]--.

COLUMN 6

Line 38, "is" should be deleted.
Line 39, "it "should be deleted.
Line 42, "accuracy" should read --accuracy.--.

UNITED STATES PATENT AND TRADEMARK OFFICE

CERTIFICATE OF CORRECTION

PATENT NO. : 5,858,197

DATED : January 12, 1999

INVENTOR(S) : HIROTO TAKAHASHI

It is certified that error appears in the above-identified patent and that said Letters Patent is hereby corrected as shown below:

COLUMN 7

Line 13, "converter" should read --convertor--.

Signed and Sealed this

Twenty-first Day of December, 1999

*Attest:*

Q. TODD DICKINSON

*Attesting Officer*

*Acting Commissioner of Patents and Trademarks*